US008288719B1

(12) United States Patent
Wells et al.

(10) Patent No.: US 8,288,719 B1
(45) Date of Patent: Oct. 16, 2012

(54) ANALYTICAL INSTRUMENTS, ASSEMBLIES, AND METHODS

(75) Inventors: James Mitchell Wells, Lafayette, IN (US); Mike Roth, Delphi, IN (US)

(73) Assignee: Griffin Analytical Technologies, LLC, West Lafayette, IN (US)

( * ) Notice: Subject to any disclaimer, the term of this patent is extended or adjusted under 35 U.S.C. 154(b) by 55 days.

(21) Appl. No.: 12/005,805

(22) Filed: Dec. 28, 2007

Related U.S. Application Data

(60) Provisional application No. 60/877,965, filed on Dec. 29, 2006.

(51) Int. Cl.
*H01J 49/26* (2006.01)

(52) U.S. Cl. ..... 250/289; 250/281; 250/283; 250/286; 250/287; 250/288

(58) Field of Classification Search ..... 250/281–300
See application file for complete search history.

(56) References Cited

U.S. PATENT DOCUMENTS

| | | | | |
|---|---|---|---|---|
| 4,531,056 | A | 7/1985 | Labowsky et al. | |
| 4,542,293 | A | 9/1985 | Fenn et al. | |
| 4,804,839 | A * | 2/1989 | Broadbent et al. | 250/288 |
| 4,948,962 | A * | 8/1990 | Mitsui et al. | 250/288 |
| 4,977,320 | A | 12/1990 | Chowdhury et al. | |
| 4,999,493 | A * | 3/1991 | Allen et al. | 250/288 |
| 5,155,357 | A * | 10/1992 | Hemond | 250/291 |
| 5,157,260 | A | 10/1992 | Mylchreest et al. | |
| 5,245,186 | A | 9/1993 | Chait et al. | |
| 5,313,061 | A * | 5/1994 | Drew et al. | 250/281 |
| 5,525,799 | A * | 6/1996 | Andresen et al. | 250/288 |
| 5,539,204 | A * | 7/1996 | Coutts et al. | 250/289 |
| 5,672,868 | A * | 9/1997 | Mordehai et al. | 250/281 |
| 5,728,584 | A * | 3/1998 | Sausa et al. | 436/106 |
| 5,744,798 | A * | 4/1998 | Kato | 250/288 |
| 5,818,041 | A * | 10/1998 | Mordehai et al. | 250/281 |
| 5,852,295 | A * | 12/1998 | Da Silveira et al. | 250/423 R |
| 6,093,929 | A * | 7/2000 | Javahery et al. | 250/282 |
| 6,107,627 | A * | 8/2000 | Nakagawa et al. | 250/292 |
| 6,265,717 | B1 * | 7/2001 | Sakata et al. | 250/289 |
| 6,351,983 | B1 | 3/2002 | Haas et al. | |
| 6,462,336 | B1 * | 10/2002 | Bajic | 250/288 |
| 6,627,877 | B1 * | 9/2003 | Davis et al. | 250/287 |
| 6,646,257 | B1 * | 11/2003 | Fischer et al. | 250/288 |
| 6,683,300 | B2 | 1/2004 | Doroshenko et al. | |
| 6,744,045 | B2 | 6/2004 | Fries et al. | |
| 6,797,947 | B2 * | 9/2004 | Russ et al. | 250/288 |
| 6,800,848 | B2 * | 10/2004 | Shiokawa et al. | 250/282 |
| 6,809,312 | B1 * | 10/2004 | Park et al. | 250/281 |
| 6,841,773 | B2 * | 1/2005 | McLoughlin et al. | 250/281 |

(Continued)

OTHER PUBLICATIONS

B. Laughlin et al., "atmospheric pressure Ionization in a Miniature Mass Spectrometer," Analytical Chemistry, vol. 77, No. 9, May 1, 2005.*

(Continued)

*Primary Examiner* — Michael Logie
(74) *Attorney, Agent, or Firm* — Wells St. John P.S.

(57) ABSTRACT

Analytical instruments configured to perform atmospheric pressure ionization are provided that are less than 50 kgs in total weight and/or less than 1 $m^3$ in total volume. Mass analysis instruments are provided that can include an interface vacuum structure operatively coupled between an ionization source and a vacuum region housing a detector. Mass analysis instruments are also provided that can include an ionization source coupled to an analysis region via an interface vacuum structure, with at least two independent vacuum components.

10 Claims, 10 Drawing Sheets

U.S. PATENT DOCUMENTS

| | | | | |
|---|---|---|---|---|
| 6,924,478 | B1 * | 8/2005 | Zubarev et al. | 250/282 |
| 6,949,741 | B2 | 9/2005 | Cody et al. | |
| 7,015,466 | B2 | 3/2006 | Takats et al. | |
| 7,091,477 | B2 * | 8/2006 | Jolliffe et al. | 250/282 |
| 7,402,799 | B2 * | 7/2008 | Freidhoff | 250/294 |
| 2001/0048074 | A1 * | 12/2001 | Shiokawa et al. | 250/286 |
| 2002/0036263 | A1 * | 3/2002 | Shiokawa et al. | 250/288 |
| 2002/0079442 | A1 * | 6/2002 | Fries et al. | 250/281 |
| 2003/0020011 | A1 * | 1/2003 | Anderson et al. | 250/287 |
| 2003/0141449 | A1 * | 7/2003 | Wells et al. | 250/292 |
| 2004/0222372 | A1 * | 11/2004 | McLoughlin et al. | 250/288 |
| 2005/0035287 | A1 * | 2/2005 | Jolliffe et al. | 250/288 |
| 2005/0173627 | A1 * | 8/2005 | Cotter et al. | 250/288 |
| 2005/0230635 | A1 | 10/2005 | Takats et al. | |
| 2005/0258364 | A1 * | 11/2005 | Whitehouse et al. | 250/292 |
| 2006/0068081 | A1 * | 3/2006 | Izawa et al. | 427/8 |
| 2006/0079002 | A1 * | 4/2006 | Gologan et al. | 436/174 |
| 2007/0114392 | A1 * | 5/2007 | Mukaibatake | 250/290 |
| 2008/0138219 | A1 * | 6/2008 | Stones et al. | 417/423.4 |
| 2008/0166219 | A1 * | 7/2008 | Stuart et al. | 415/90 |

OTHER PUBLICATIONS

Ecelerger et al., "suitcase TOF: A Man-Portable Time-of-Flight Mass Spectrometer", Johns Hopkins APL Technical Digest, vol. 25, No. 1 (2004).*

* cited by examiner

ANALYTICAL INSTRUMENTS, ASSEMBLIES, AND METHODS

CROSS REFERENCE TO RELATED APPLICATION

This application claims priority to U.S. provisional patent application 60/877,965 which was filed Dec. 29, 2006, entitled "Analytical Instruments, Assemblies, and Methods", the entirety of which is incorporated by reference herein.

GOVERNMENT RIGHTS STATEMENT

This invention was made with Government support under SBIR Phase-II Grant 0450512 awarded by the National Science Foundation. The Government has certain rights in the invention.

TECHNICAL FIELD

The present disclosure relates to analytical instruments, instrumentation, instrument assemblies, and analytical methods. More specific embodiments include mass analysis instrumentation as well as mass analysis methods.

BACKGROUND

Analytical instrumentation and particularly mass analysis instrumentation can be utilized to determine both the identity and amount of unknown compounds and mixtures. It is desirable to determine the identity and amount of unknown compounds and mixtures at their point of origin rather than obtaining a sample and transporting that sample to a laboratory for analysis, at least in that sampling and transportation of samples can contaminate the sample obtained and/or because sampling is not practical. Furthermore, it may be important to quickly ascertain the identity and amount of unknown compounds and sampling and transportation of the sample does not facilitate quick analysis. The capability that mass spectrometry provides is sought after for many uses including field applications where the instrument would ideally be brought to the sample rather than the more traditional transportation of the sample to the laboratory.

At least some embodiments of the analytical instrumentation and methods are portable and can be transported to where the chemistry happens, outside the laboratory.

BRIEF DESCRIPTION OF THE DRAWINGS

Embodiments of the disclosure are described below with reference to the following accompanying drawings.

FIGS. 7-9 are data acquired utilizing the instruments and methods described herein.

SUMMARY

Analytical instruments configured to perform atmospheric pressure ionization are provided that are less than 50 kgs in total weight and/or less than 1 $m^3$ in total volume.

Mass analysis instruments are provided that can include an interface vacuum structure operatively coupled between an ionization source and a vacuum region housing a detector.

Mass analysis instruments are also provided that can include an ionization source coupled to an analysis region via an interface vacuum structure, with at least two independent vacuum components.

Analytical instruments are provided that can include a housing encompassing an operational number of analytical components, and an ionization source being at least one of the analytical components, the ionization source being configured to be operational under atmospheric pressure; an analysis region being at least another of the analytical components, the analysis region comprising an interface region and a vacuum region, the interface region being coupled to both the ionization region and the vacuum region; and at least two vacuum sources within the housing, one of the vacuum sources being coupled to the interface region and another vacuum source being coupled to the vacuum region.

Instrumental analytical methods are provided that can include ionizing at least a portion of sample under atmospheric pressure to form a plurality of analytes, and guiding at least some of the analytes to a vacuum region for analysis using a interface region at a first pressure less than atmospheric pressure, the vacuum region being a second pressure less than the first pressure.

DESCRIPTION

This disclosure is submitted in furtherance of the constitutional purposes of the U.S. Patent Laws "to promote the progress of science and useful arts" (Article 1, Section 8).

At least some embodiments provide analytical instruments, assemblies, and/or methods. Exemplary configurations of these instruments, assemblies, and/or methods are described with reference to FIGS. 1-11.

Figure 1:
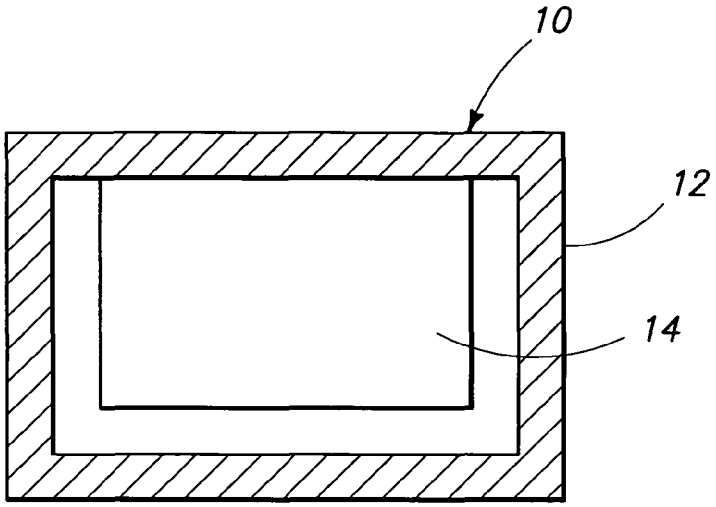
FIG. 1 is an illustrative view of an instrument according to an embodiment.

Referring first to FIG. 1, an example analytical instrument 10 is depicted that includes a supporting structure 12 coupled to at least one of instrument components 14. Analytical instrument 10 can include mass analysis instrumentation such as mass spectrometry instrumentation, for example.

In an example embodiment, structure 12 can support, surround, and/or partially surround components 14. Components 14 can include an operational number of components, for example, all components necessary to acquire mass spectral characteristics of a sample. According to some embodiments, structure 12 can be referred to as a frame, base, case, cabinet, and/or any structure that can define a space occupied by components 14. An example material of structure 12 includes aluminum. In some configurations the space defined by structure 12 is no greater than or equal to about 1 $m^3$ in volume. In other configurations the space defined by structure 12 is between 0.01 $m^3$ and 0.15 $m^3$ in volume.

According to example implementations, instrument 10 including housing 12 encompassing components 14 can have a weight no greater than or equal to about 50 kg. According to other implementations, instrument 10 can have a total weight of between 4 and 50 kgs. Exemplary configurations of instrument 10 are person-portable. Person-portable instruments include those instruments that can be transported by an individual outside the traditional laboratory. These instruments can be self-contained including a power source, or they can be configured to utilize power sources available in the field.

Figure 2:
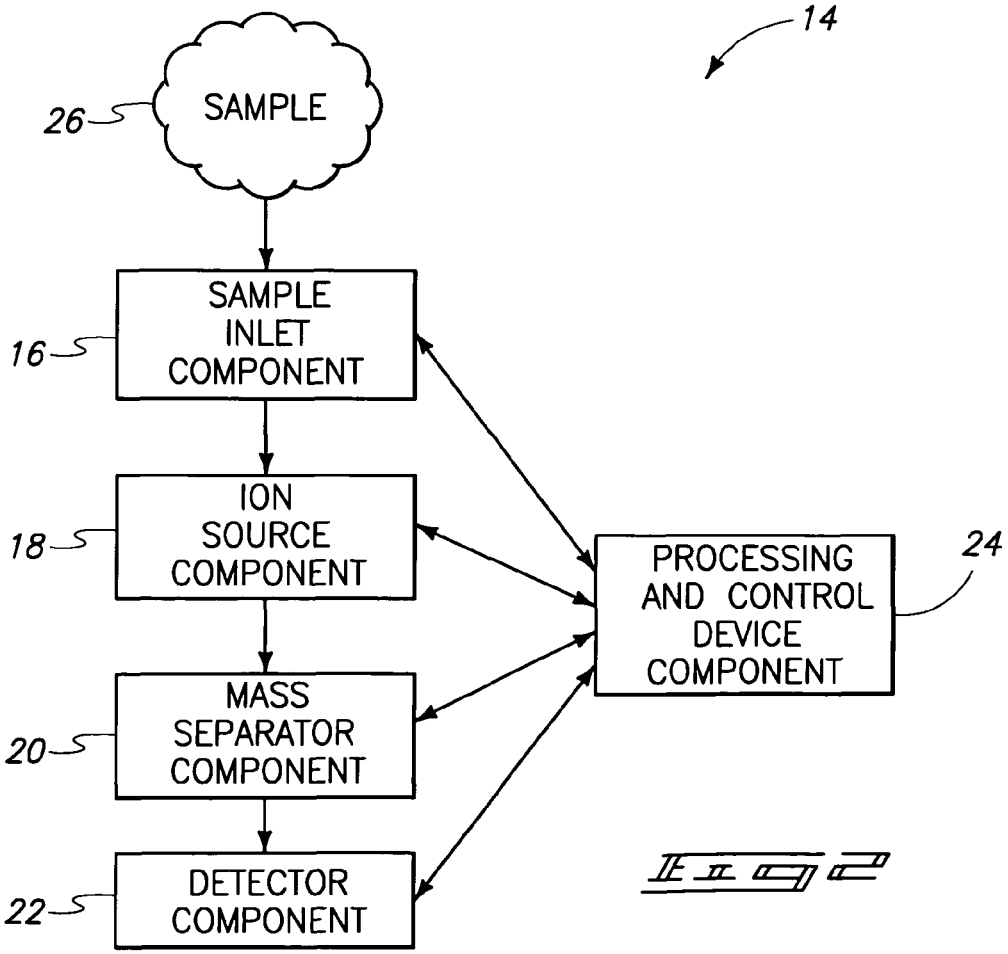
FIG. 2 is an illustrative representation of instrument components according to an embodiment.
Figure 2:
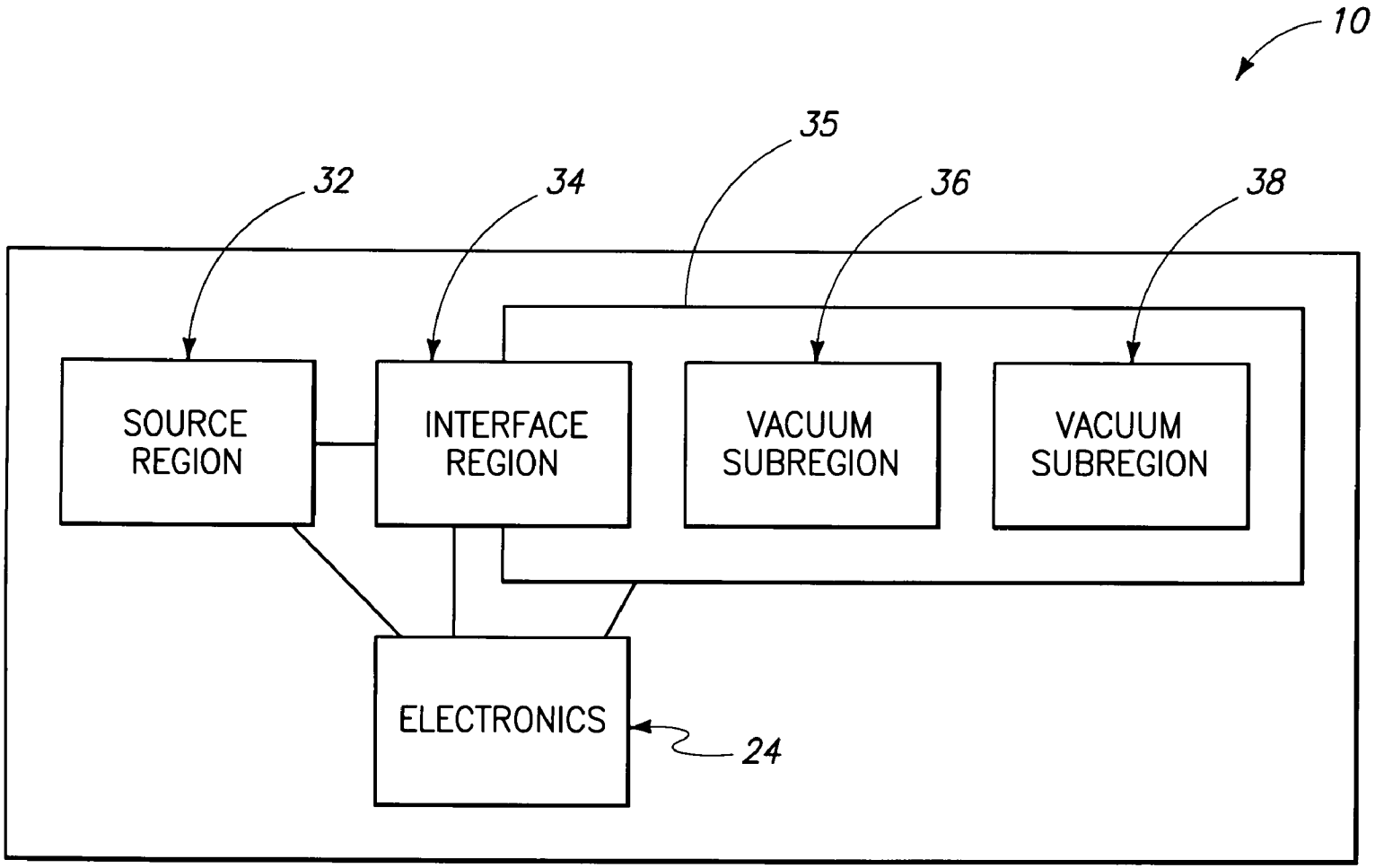

With reference to FIG. 2, instrument components 14 can include mass analysis components, such as sample inlet component 16 operationally connected and/or coupled to an ion source component 18 which can be operationally connected and/or coupled to a mass separator component 20 which can be operationally connected and/or coupled to a detector component 22. Any and/or all of these components alone or in combination can be operationally connected and/or coupled to a processing and control device component 24. Exemplary embodiments provide for the use of components 14 to perform mass analysis including mass spectrometry. Components 14 can be operationally connected as shown in FIG. 2 or operationally connected in other configurations enabling mass analysis methods. Further, other arrangements including more or less or alternative components are possible.

As depicted in FIG. 2, a sample 26 can be introduced into sample inlet component 16. For purposes of this disclosure, sample 26 represents any chemical composition including both inorganic and organic substances in solid, liquid, and/or vapor form. Specific examples of sample 26 suitable for analysis include volatile compounds such as toluene or other specific examples including highly-complex non-volatile protein based structures such as bradykinin. In certain aspects, sample 26 can be a mixture containing more than one substance or in other aspects, sample 26 can be a substantially pure substance. Analysis of sample 26 can be performed according to exemplary aspects described below.

Sample inlet component 16 can be configured to introduce an amount of sample 26 into instrument 10 (FIG. 1) for analysis. Depending upon sample 26, sample inlet component 16 may be configured to prepare sample 26 for ionization. Types of sample inlet components 16 can include batch inlets, direct probe inlets, chromatographic inlets, and permeable, semi-permeable, solid phase microextraction (SPME), and/or capillary membrane inlets. Sample inlet component 16 can also include means for preparing sample 26 for analysis in the gas, liquid, and/or solid phase. In some aspects, sample inlet component 16 may be combined with ion source component 18.

Component 18 can be configured to convert portions or an entirety of sample 26 into analyte ions in one example. This conversion can include the bombardment of sample 26 with electrons, ions, molecules, and/or photons. This conversion can also be performed by thermal or electrical energy.

Ion source component 18 may utilize, for example, chemical ionization, and/or electrospray ionization (ESI). Also, when utilizing ESI, sample 26 can be energized under atmospheric pressure. Ion source component 18 can be configured to perform atmospheric pressure ionization, for example.

Ion source component 18 can also be configured to fragment analytes without ionizing the analytes. In exemplary implementations, the analytes may be fragmented after ionization. An exemplary fragmentation technique includes collisionally activated disassociation.

The analyte ions can proceed from ion source component 18 to mass separator component 20, for example. Mass separator component 18 can include one or more of linear quadrupoles, triple quadrupoles, quadrupole ion traps (Paul), cylindrical ion traps, linear ion traps, rectilinear ion traps, ion cyclotron resonance, quadrupole ion trap/time-of-flight mass spectrometers, or other structures. Mass separator component 18 can also include focusing lenses as well as tandem mass separator components such as tandem ion traps or ion traps and quadrupoles in tandem. In one implementation, at least one of multiple tandem mass separator components can be an ion trap. Tandem mass separator components can be placed in series or parallel. In an exemplary implementation, tandem mass separator components can receive ions from the same ion source component. In an exemplary aspect, the tandem mass separator components may have the same or different geometric parameters. The tandem mass separator components may also receive analyte ions from the same or multiple ion source components.

Analytes may proceed to detector component 22 from mass separator component 20. Example detector components include electron multipliers, Faraday cup collectors, photographic and scintillation-type detectors.

Acquisition and generation of data can be facilitated with processing and control device component 24. Exemplary embodiments provide that the progression of mass spectrometry analysis from sample inlet component 16 to detector component 22 can be controlled and monitored by a processing and control device component 24. Processing and control device component 24 can be a computer or mini-computer or other appropriate circuitry that is capable of controlling components 14. This control can include, for example, the specific application of voltages to ion source component 18 and mass separator component 20, as well as the introduction of sample 26 via sample inlet component 16, and may further include determining, storing and ultimately displaying mass spectra recorded from detector component 22. Processing and control device component 24 can contain data acquisition and searching software. In one aspect, such data acquisition and searching software can be configured to perform data acquisition and searching that includes the programmed acquisition of total analyte count. In another aspect, data acquisition and searching parameters can include methods for correlating the amount of analytes generated to predetermine programs for acquiring data.

As the space defined by structure 12 (e.g., FIG. 1) can be considered small when compared to typical instruments, in example embodiments, instrument 10 can be person-portable and/or packable, and components 14 can be configured to provide multiple levels of analysis (e.g., multidimensional analysis such as MS/MS) from a person-portable instrument. Structure 12 can be coupled to components 14 via attachment devices, and structure 12 may include openings (not shown) to allow access to components 14. These openings can remain open or structure 12 may include doors or panels allowing access to components 14 upon respective opening or removal.

Referring to FIGS. 1 and 2, an example configuration of components 14 of instrument 10 is shown that can include at least one of sample inlet components 16 coupled to structure 12. Instrument components 14 can also include at least one of analysis components coupled to at least one of sample inlet components 16 and at least one of processing and control components 24. Analysis components can include components configured to perform analytical analysis including but not limited to components 18, 20, and 22 described above. As depicted for example purposes, at least one of processing and control components 24 can be coupled to at least one of sample inlet components 16 and structure 12. Embodiments of instrument components 14 include structure 12 only being coupled to at least one of sample inlet components 16 with none of processing and control components 24 being coupled to structure 12.

Instrument components 14 can be configured to provide mass spectral data, for example. Instrument components 14 can further include a power supply coupled to processing and control components 24 and, as necessary, inlet components 16 and analysis components 24. Exemplary power supplies can include portable batteries such as sealed lead-acid and/or lithium ion or polymer batteries. In other embodiments, the power supply may be located outside the space defined by structure 12.

Figure 3A:
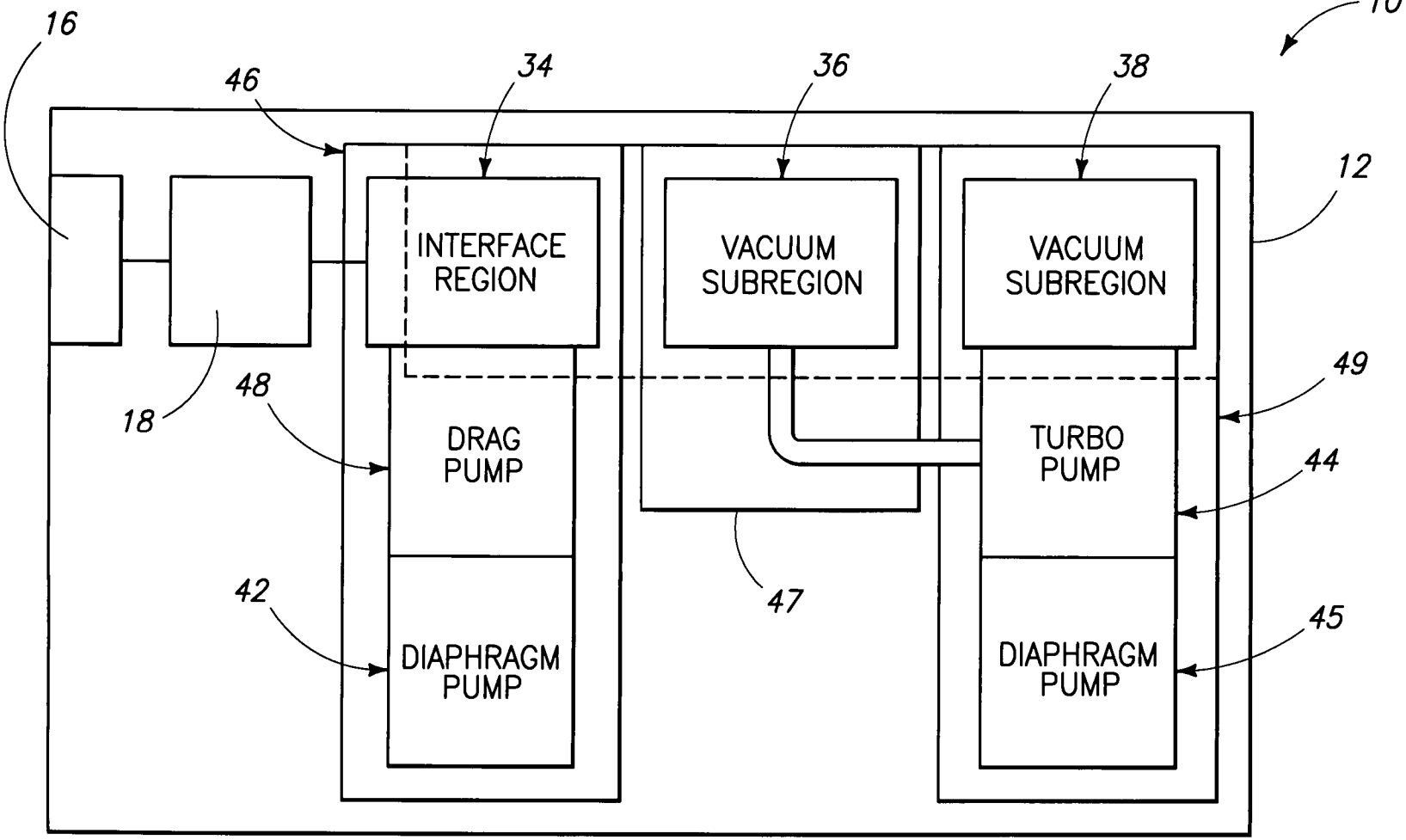
FIG. 3 is an illustrative view of the instrument of FIG. 1 according to an embodiment.

Referring to FIG. 3 component 18 is shown configured as an atmospheric pressure ionization (API) source region 32 coupled to a vacuum region 35 via an interface region 34, all of which being coupled to component 24, such as an electronics region. Source region 32 can further be configured as, but not limited to, electrospray ionization (ESI), electrosonic-spray ionization (ESSI), Direct Analysis in Real Time (DART), Desorption Electrospray Ionization (DESI), atmospheric pressure chemical ionization (APCI), or atmospheric pressure matrix-assisted laser desorption ionization (AP-MALDI).

Interface region 34 can be configured to couple source 32 to vacuum region 35. Vacuum region 35 can be configured to house separator components 20 and/or detector components 22, for example. Vacuum region 35 can also house vacuum subregions 36 and 38. While FIG. 3 depicts two subregions, more or less subregions can be utilized. For example, vacuum region 35 can be maintained at a uniform pressure having only one subregion. As another example, subregions 36 and 38 can be maintained at different pressures. Region 35 does not require both subregions 36 and 38. As an example, where only one subregion is utilized, the subregion can have the same pressure as region 35. Components 14 can include region 34 coupled to either or both of subregions 36 and 38. For example, region 34 may be directly coupled to subregion 38.

Region 34 can be configured to transfer ions from source 32 into region 35. Transfer of ions from source 32 to region 35 can be accomplished through, including but not limited to, the use of a capillary tube transfer element combined with a skimmer element to transfer ions to region 35. As such region 34 can be configured as capillary tube transfer element combined with a skimmer element. Region 34 can be maintained at a pressure less than that of source 32.

Subregion 36 can be configured to facilitate the transfer of the ions from interface 34 to subregion 38. Subregion 36 may consist of multiple vacuum regions between the pressure of the region 34 and that of the subregion 38. Transfer of ions from subregion 36 to subregion 38 may be accomplished via DC lenses, RF lenses such as octapoles, for example. Subregion 38 can include the mass analyzer, such as but not limited to quadrupole ion traps, linear ion traps, cylindrical ion traps, linear quadrupoles, time-of-flight analyzers, magnetic sector analyzers, or magnetic/electric sector combination analyzers. An example mass separator component 20 useful in accordance with one embodiment is a cylindrical ion trap (CIT). CITs typically include three components: a trapping volume and two endcaps. Typically an RF voltage is applied to the trapping volume at a predefined rate (e.g., controlled by 50) to eject trapped analytes which are subsequently detected. RF voltage ramps may include variables such as power and/or frequency. Combinations of these variables in predefined amounts are typically referred to as waveforms. Generally, waveforms can be optimized to increase detection of specific analytes of interest. Waveforms can also be optimized to allow for multiple stages of mass analysis.

In an example embodiment, mass separator component 20 within region 35 can be a cylindrical ion trap and the mass separator parameter of the cylindrical ion trap can be a parameter that influences the mass-to-charge ratio of ionized analytes received by detector component 22. An example cylindrical ion trap parameter value that influences the mass-to-charge ratio of ionized analytes received by detector component 22 is a mass-to-charge ratio range that can be specified as waveform values.

Housing 12 of instrument 10 can be configured to fully contain the vacuum system utilized by components 18, 20 and 22, as well as regions 34 and 35 and/or subregions 36 and 38. In accordance with an example configuration there are no external pumps or other components related to the vacuum system outside housing 12 of analytical instrument 10.

Figure 4B:
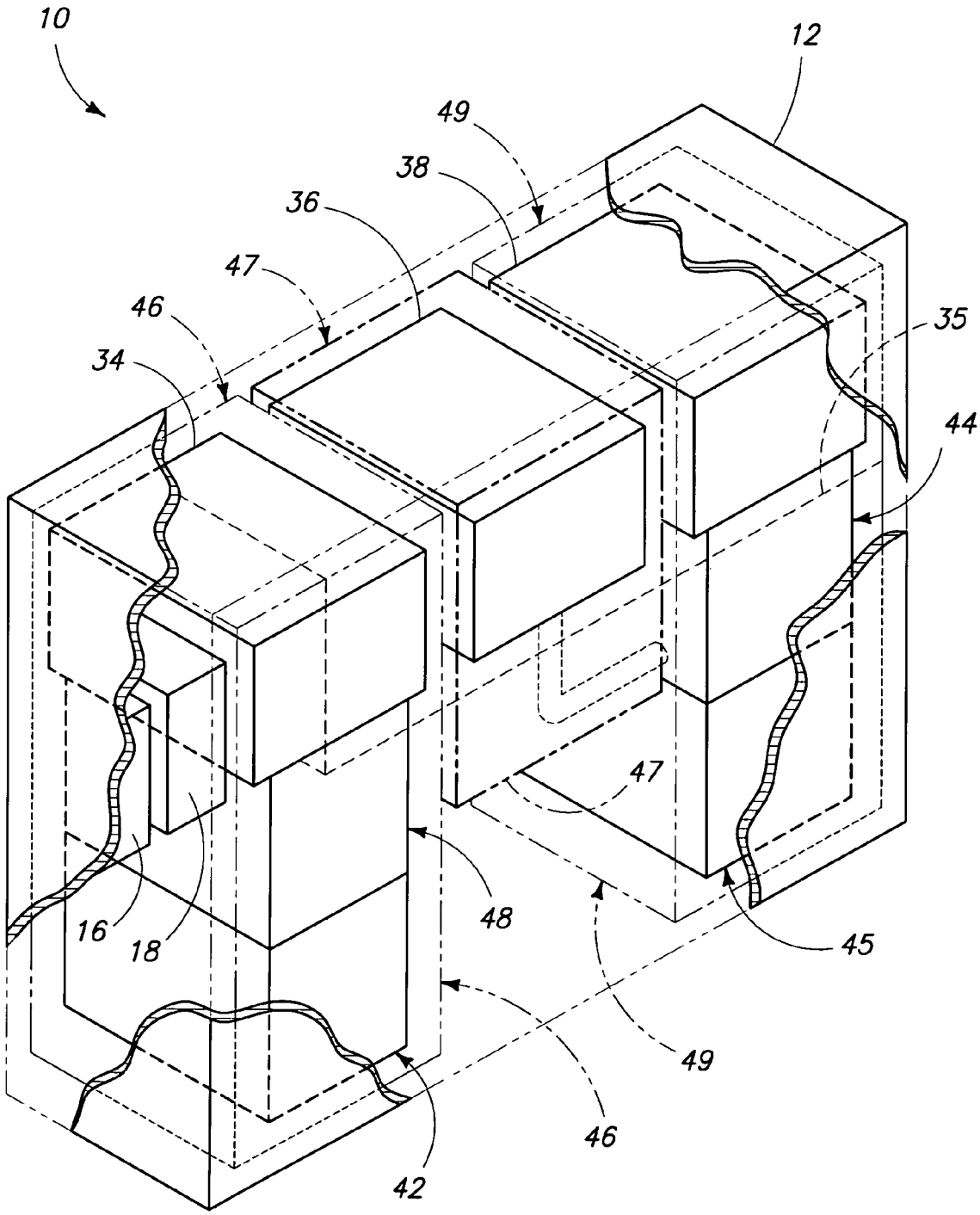
FIGS. 4A and B is an illustrative view of the instrument of FIG. 1 according to an embodiment.
Figure 5A:
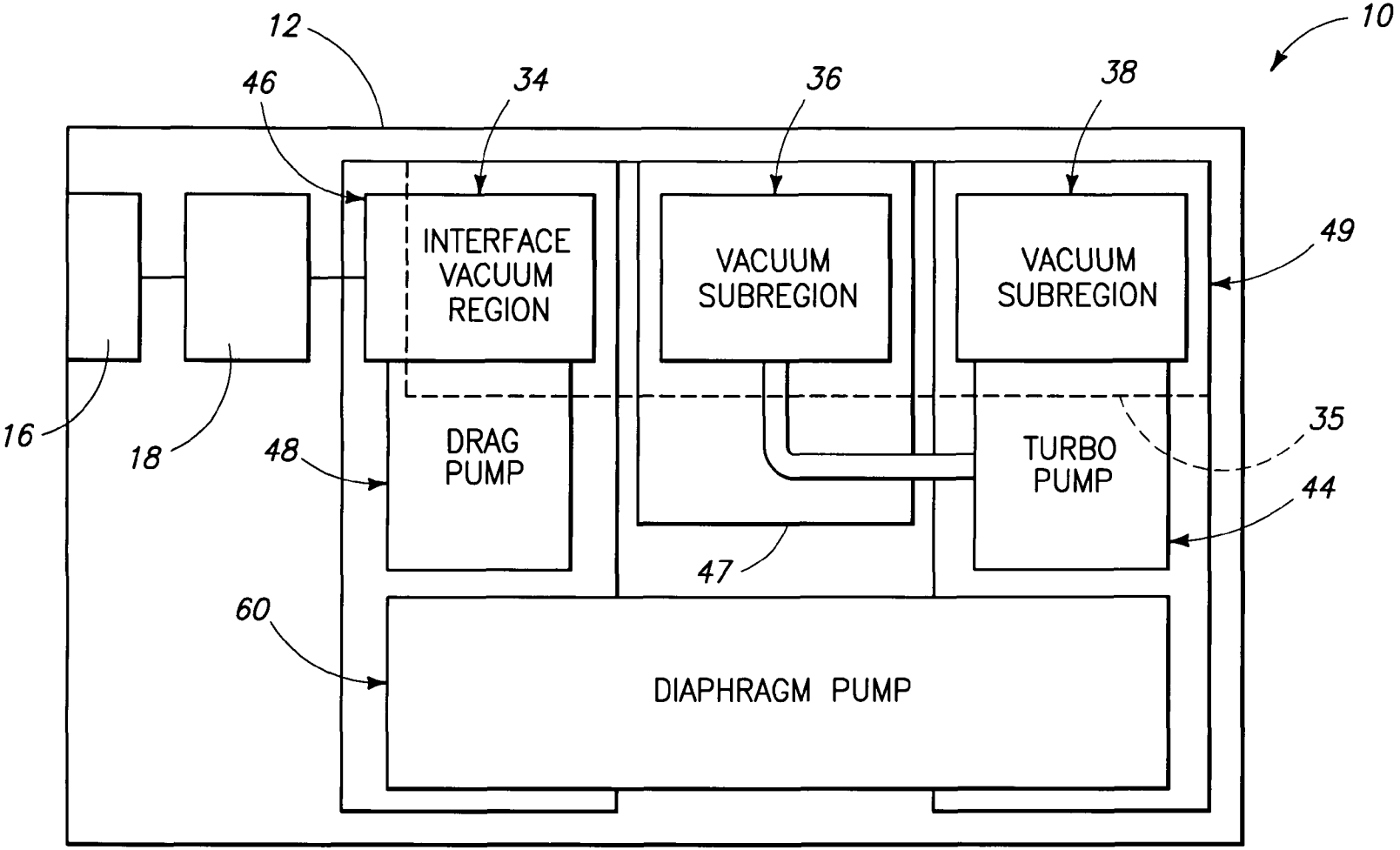
FIGS. 5A and B is an illustrative view of the instrument of FIG. 1 according to an embodiment.
Figure 5B:
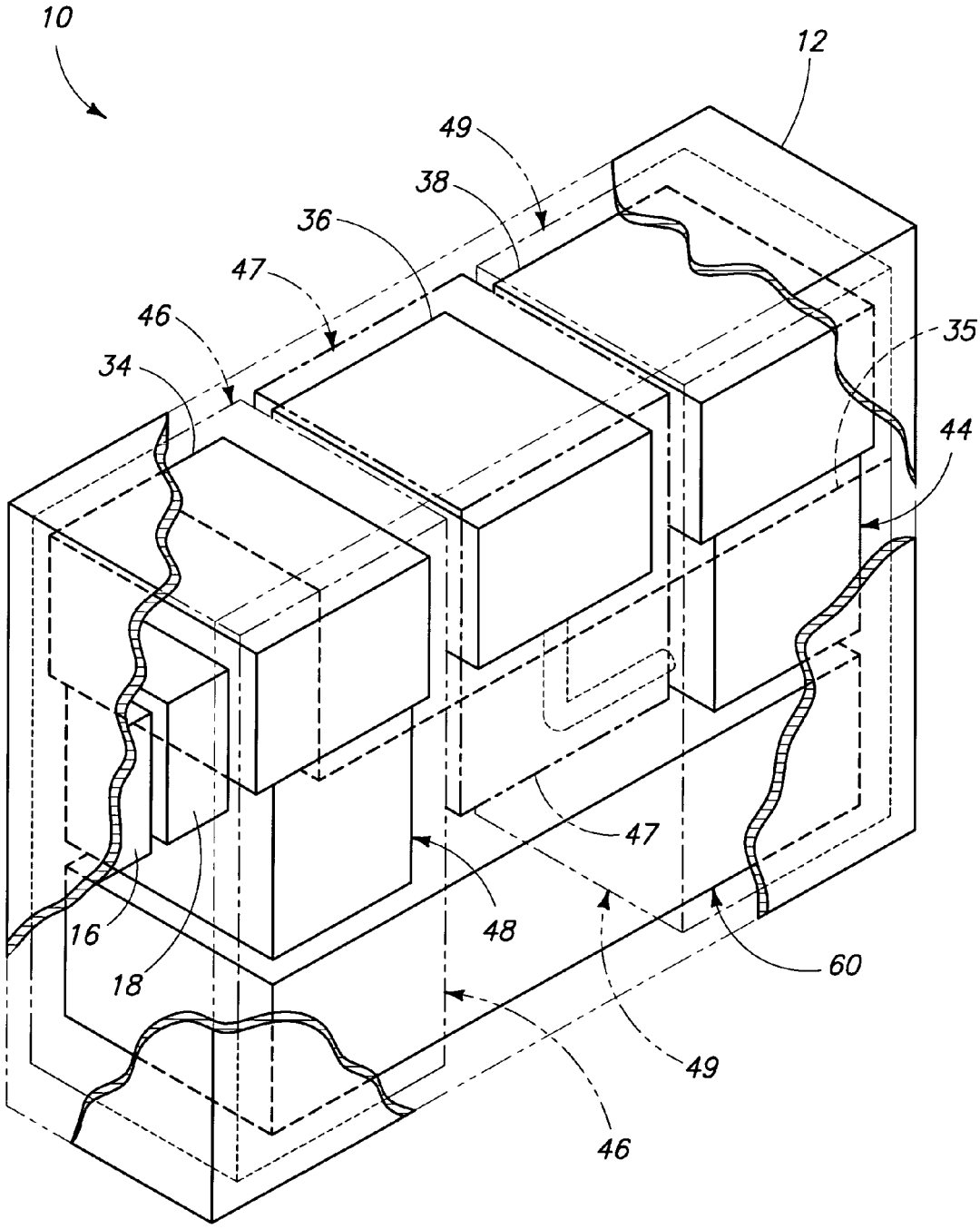

Referring to FIGS. 4-6, example arrangements of components 14 within the housing 12 of instrument 10 are depicted. Referring first to FIG. 4A, an example elevation of instrument 10 is shown depicting components 14 arranged according to an example embodiment within instrument 10. Housing 12 is coupled to inlet component 16 which is also coupled to source component 18. Between component 18 and vacuum region 35 resides interface region 34.

Region 34 can be operatively coupled to a vacuum structure 46. Structure 46 can include an independent vacuum source, such as a drag pump 48. In the shown embodiment, structure 46 includes two vacuum sources serially aligned within structure 46, a drag pump 48 and a diaphragm pump 42. However, it is contemplated that specific implementations of interface region 34 can be maintained at adequate pressure with a single vacuum source. According to the depicted embodiment, drag pump 48 can be an Alcatel MDP5011 or TPD021 drag pump (obtained from Midwest Vacuum, Inc., 201 E. Ogden Avenue, Suite 15, Hinsdale, Ill. 60521, 630-323-5399 or US Headquarters, Pfeiffer Vacuum, 24 Trafalgar Square Nashua, N.H. 03063, 603-578-6500, respectively) and diaphragm pump 42 can be a KNF Neuberger N920 diaphragm pump (KNF NEUBERGER, INC., Two Black Forest Road, Trenton, N.J. 08691-1810 USA, 609-890-8600).

Subregion 36 can be operatively aligned between region 34 and subregion 38 within vacuum region 35. As an example, subregion 36 can define a vacuum structure 47 distinct from that of region 34 and/or subregion 38. Structure 47 can be coupled to at least a portion of vacuum structure 49 defined by subregion 38. Subegion 38 can define a vacuum structure 49 such as a housing coupled to turbo pump 44 which can be serially aligned with diaphragm pump 45. According to an example embodiment, structure 47 can be in fluid connection with structure 49 and thereby reliant on the vacuum sources of structure 49 such as pumps 44 and 45 which can be Pfeiffer TMH071-003 split flow turbo pump (US Headquarters, Pfeiffer Vacuum, 24 Trafalgar Square Nashua, N.H. 03063, 603-578-6500) and KNF Neuberger 813.4 diaphragm pumps, respectively.

The specific pumps referenced in relation to regions 34, 36 and 38 are but examples that can, according to some embodiments, facilitate housing instrument 10 within the defined space. Other pumps configured the same or differently may be utilized.

Referring to FIG. 4B, a perspective view of instrument 10 is shown with the example components of instrument 10 within housing 12.

Referring to FIG. 5A, another embodiment of instrument 10 is shown with diaphragm pump 60 being coupled to both structures 46 and 49. An example diaphragm pump is a KNF Neuberger N920 diaphragm pump. As such two distinct vacuum structures can share a vacuum source such as the diaphragm, yet be maintained at distinct pressures, for example.

Figure 6A:
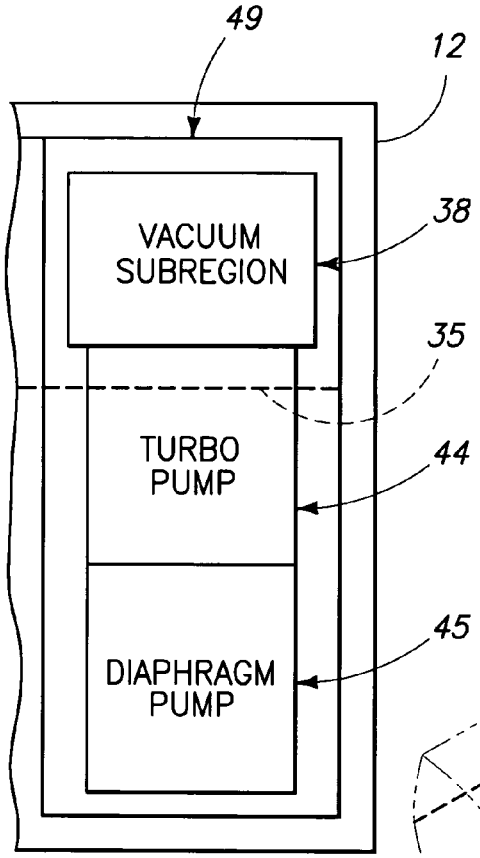
FIGS. 6A and B is an illustrative view of the instrument of FIG. 1 according to an embodiment.
Figure 6B:
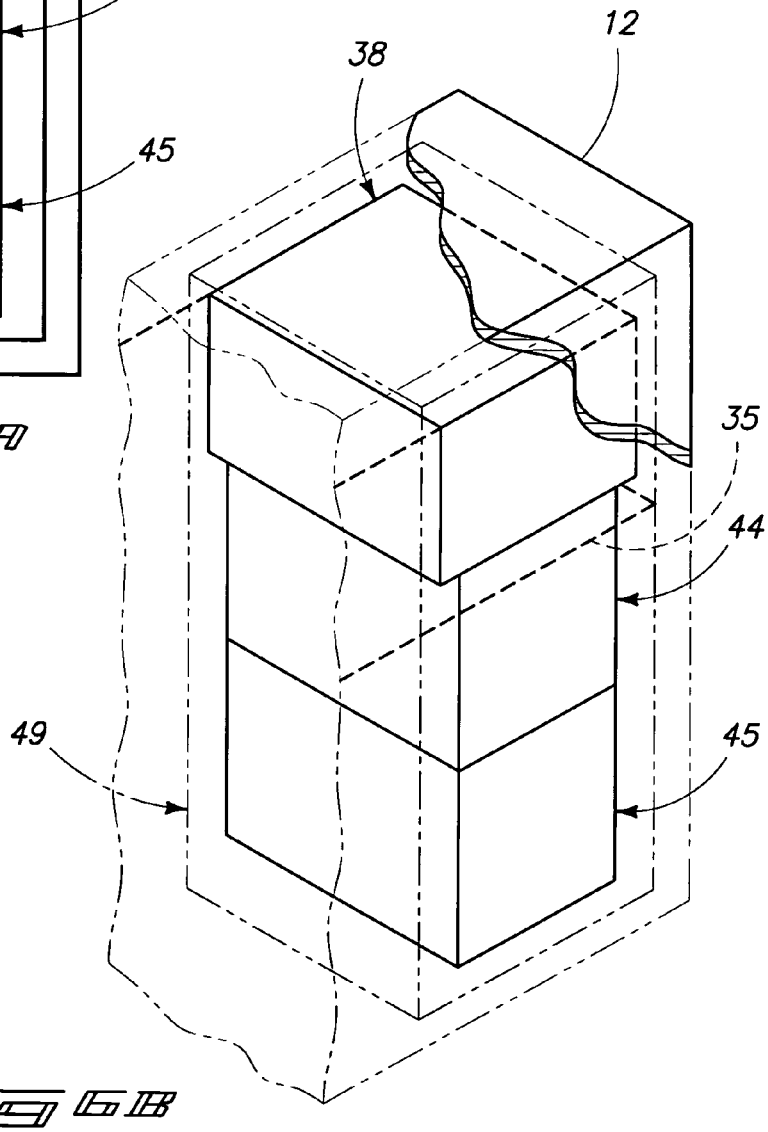

According to another example embodiment and referring to FIGS. 6A and 6B, vacuum region 35 can include a single vacuum structure 49 that is coupled to interface region 34.

Structure 49 can be coupled to turbo pump 44 and/or diaphragm pump 45, for example. The turbo pumps and diaphragm pumps utilized can be those described previously.

Analytes prepared using components 16, 18, and/or 20 can be detected in detection component 22, for example. Exemplary detection components include electron multipliers, Faraday cup collectors, photographic, and scintillation-type detectors as described above.

Processing and control components 24 can be coupled to components 16, 18, 20, and/or 22, for example. All the components described above can be controlled, monitored, and/or have data acquired from by processing and control components 24. In exemplary embodiments, all, or at least more than one of, the components described above can be coupled to processing and control components 24.

Referring again to FIG. 2, processing and control component 24 can have a user interface coupled to structure 12 of instrument 10 (FIG. 1). Processing and control component 24 can also include processing circuitry coupled to both the user interface and storage circuitry.

According to one embodiment, the user interface can be coupled to structure 12 and provide user access to process circuitry. The user interface can take the form of a touch screen aligned with the exterior of structure 12 in exemplary embodiments, and the user interface can be within the volume defined by structure 12 Access to the user interface can be had through access panels, doors or openings in structure 12. In other embodiments, the user interface can be a computer interface that is configured to provide access to another process and control component, for example a stand alone computer. In exemplary embodiments, the computer interface can be a wireless interface and in other embodiments, the computer interface can take the form of a TCP/IP or a standard LAN connection. In exemplary embodiments, instrument 10 can be configured to accumulate and store sample data unattended. In other embodiments, instrument 10 can be configured to allow access to data and further provide for the manipulation of the data acquired. According to another embodiment, instrument 10 can be configured to send data to a remote computer upon acquisition.

In one embodiment, the progression of analysis from sample inlet component 16 to analysis component 22 can be controlled and/or monitored by the processing circuitry. The processing circuitry may be implemented as a processor or other structure configured to execute executable instructions including, for example, software and/or firmware instructions. Other exemplary embodiments of processing circuitry include hardware logic, PGA, FPGA, ASIC, and/or other structures. These examples of the processing circuitry are for illustration, and other configurations are possible.

The processing circuitry can be configured to control the values of analytical component parameters defined by the user of instrument 10 and/or monitor the components described above. Control of the analytical component parameter values by processing circuitry can include, for example, dictating a predefined application of ionization energy by modification component 20, such as components within regions 34, 36, and/or 38, for example. Exemplary monitoring includes the recording of data received from detector component 22. By varying analytical component parameter values, sample characteristics and/or data can be obtained. Exemplary sample characteristics and data can include mass spectra.

In one aspect, processing circuitry may execute data acquisition and searching programming and be configured to perform data acquisition and searching that includes the acquisition of sample characteristics such as total ion current or mass spectra. In another aspect, processing circuitry can be configured to associate detected sample characteristics such as total ion current responsive to one or more analytical parameters such as an ionization parameter including electron impact ion source energy.

The processing circuitry can be configured to store and access data from storage circuitry. The storage circuitry can be configured to store electronic data and/or programming such as executable instructions (e.g., software and/or firmware), data, or other digital information, and may include processor-usable media. Processor-usable media includes any article of manufacture which can contain, store or maintain programming, data and/or digital information for use by or in connection with an instruction execution system including processing circuitry, in the exemplary embodiment. For example, exemplary processor-usable media may include any one of physical media such as electronic, magnetic, optical, electromagnetic, and infrared or semiconductor media. Some more specific examples of processor-usable media include, but are not limited to, a portable magnetic computer diskette, such as a floppy diskette, zip disk, hard drive, random access memory, read only memory, flash memory, cache memory, and/or other configurations capable of storing programming, data, or other digital information. Embodiments also include configurations where processing and control components 24 can be configured to acquire sample data and analyze acquired data unattended. For example, sample inlet component 16 can be configured as an auto-sampler and, in exemplary embodiments, air samples can be acquired at predefined intervals as dictated by processing and control component 24. Processing and control component 24 can be configured according to predefined user parameters to acquire sample data. In other embodiments, processing and control component 24 can be configured to forward data and/or instrument status to remote locations via wireless and/or wired communication.

Figure 8:
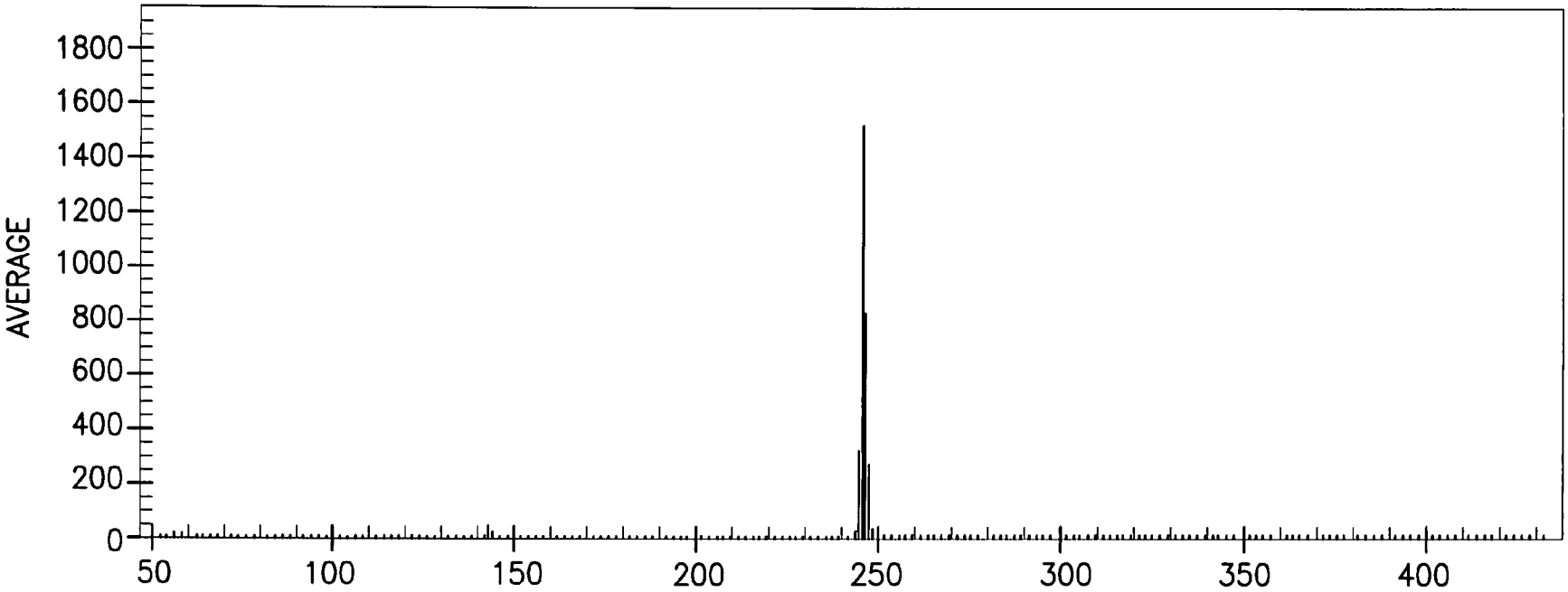
Figure 11:
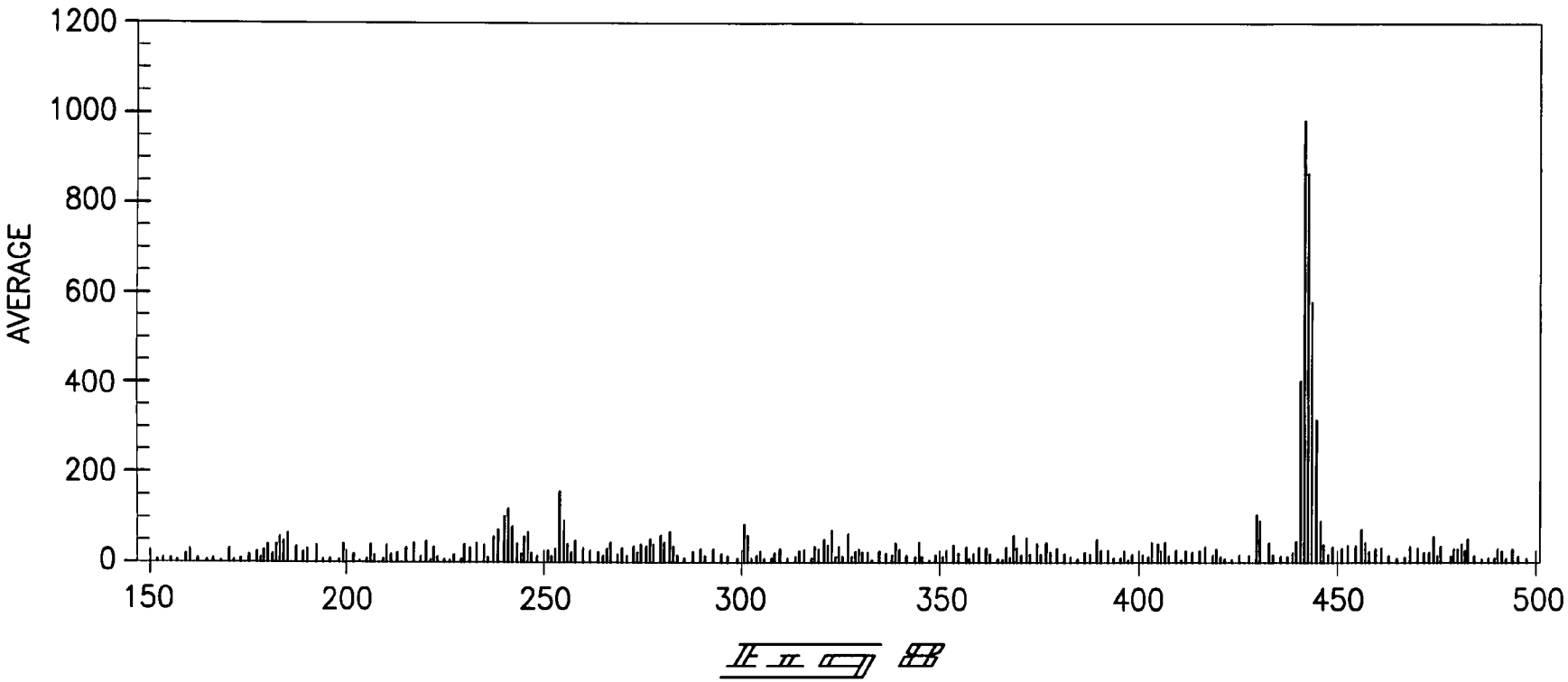
Figure 9:
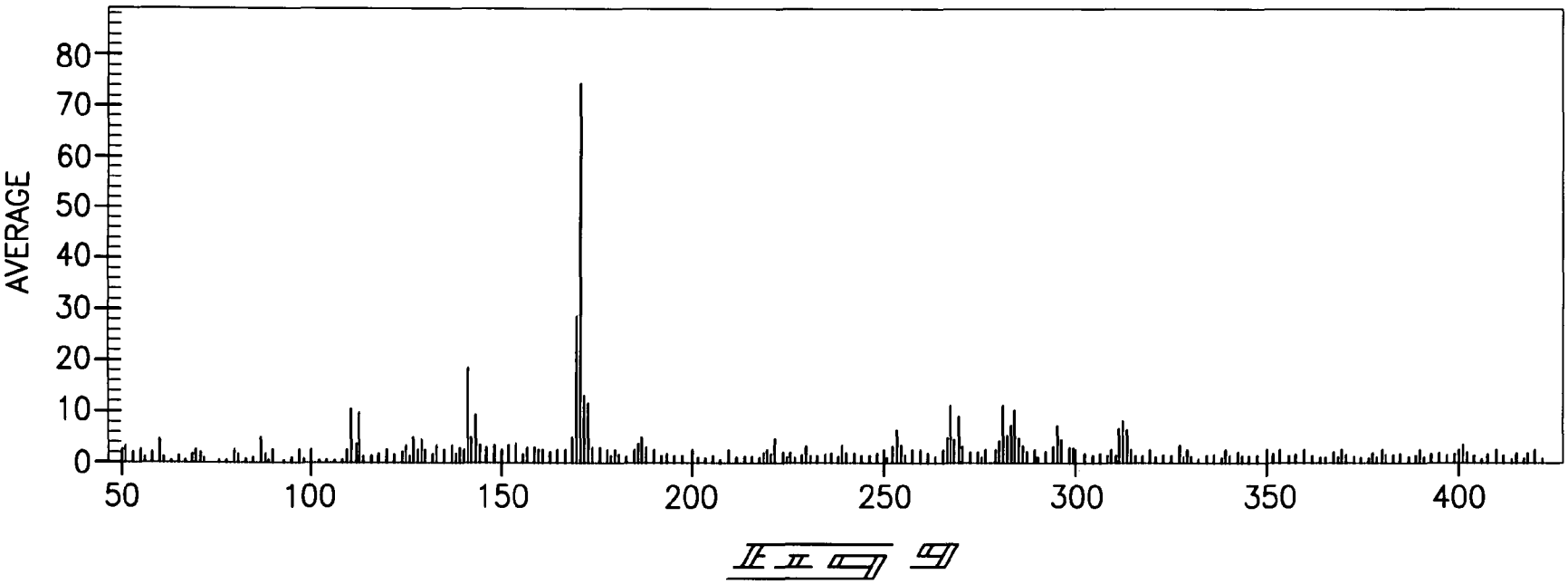

Referring to FIGS. 7-9, example data acquired utilizing instrument 10 is depicted. FIG. 6 illustrates data collected with Electrospray Ionization (ESI) as the API source for the chemical compound of Tetrabutylammonium Iodide. FIG. 7 illustrates data collected with Desorption Electrospray Ionization (DESI) as the API source for the rhodamine dye present in red ink. FIG. 8 illustrates data collected with Direct Analysis in Real Time (DART) as the API source 6 for a Vitamin C pill.

In compliance with the statute, embodiments of the invention have been described in language more or less specific as to structural and methodical features. It is to be understood, however, that the entire invention is not limited to the specific features and/or embodiments shown and/or described, since the disclosed embodiments comprise forms of putting the invention into effect. The invention is, therefore, claimed in any of its forms or modifications within the proper scope of the appended claims appropriately interpreted in accordance with the doctrine of equivalents.

The invention claimed is:

1. A mass analysis instrument comprising:

a housing having sidewalls, the sidewalls of the housing defining an enclosed space of less than one cubic meter, the enclosed space containing all components of the instrument operable to perform mass analysis, wherein the housing and the components of the instrument have a mass less than 50 kgs;

within the space defined by the housing, an atmospheric ionization source operatively coupled to a drag pump;

within the space defined by the housing, a vacuum manifold operatively coupled to the atmospheric ionization source, the vacuum manifold including two regions, a first of the two regions configured to interface with the atmospheric ionization source, a second of the two regions operatively interfacing with the first region, the first region maintained at a pressure less than the source, the second region maintained at a pressure less than the first region; and within the space defined by the housing, a mass analyzer within the second region.

2. The instrument of claim 1 wherein the mass analyzer includes a cylindrical ion trap coupled to an electron multiplier detector.

3. The instrument of claim 1 further comprising a skimmer operatively interfacing the first and second regions of the vacuum manifold.

4. The instrument of claim 1 wherein within the space defined by the housing, a plurality of vacuum pumps are contained and operatively coupled to the ionization source and the first and second regions of the vacuum manifold, wherein at least two of the plurality of vacuum pumps are mechanically different.

5. The instrument of claim 4 wherein one or more of the plurality of vacuum pumps is a turbo pump.

6. The instrument of claim 4 wherein one or more of the plurality of vacuum pumps is the drag pump.

7. A mass analysis instrument comprising:

a housing having sidewalls, the sidewalls of the housing defining an enclosed space;

within the space defined by the housing, an atmospheric ionization source operatively coupled to a drag pump;

within the space defined by the housing, a vacuum manifold operatively coupled to the atmospheric ionization source, the vacuum manifold including two regions, a first of the two regions configured to interface with the atmospheric ionization source, a second of the two regions operatively interfacing with the first region, the first region maintained at a pressure less than the source, the second region maintained at a pressure less than the first region;

within the space defined by the housing, a mass analyzer within the second region; and within the space defined by the housing, a plurality of vacuum pumps are contained and operatively coupled to the ionization source and the first and second regions of the vacuum manifold, wherein at least one of the plurality of vacuum pumps includes the drag pump.

8. The mass analysis instrument of claim 7 wherein the drag pump is operatively coupled to the ionization source.

9. The mass analysis instrument of claim 7 wherein at least one of the plurality of vacuum pumps includes a turbomolecular pump, the turbomolecular pump being operatively coupled to one or both of the first and second regions.

10. The mass analysis instrument of claim 9 wherein at least one of the plurality of vacuum pumps includes one or more diaphragm pumps, both the drag pump and the turbomolecular pump being backed by the one or more diaphragm pumps.

* * * * *